US005513394A

United States Patent [19]

Kodaira

[11] Patent Number: 5,513,394

[45] Date of Patent: May 7, 1996

[54] CHEMICALS MIXED TYPE AUTOMATIC FLUSHING DEVICE

[75] Inventor: Makoto Kodaira, Shinagawa, Japan

[73] Assignee: Uro Denshi Kogyo Kabushiki Kaisha, Tokyo, Japan

[21] Appl. No.: 312,147

[22] Filed: Sep. 26, 1994

[30] Foreign Application Priority Data

Oct. 26, 1993 [JP] Japan ..... 5-057713 U

[51] Int. Cl.[6] ..... E03D 9/02

[52] U.S. Cl. ..... 4/224; 4/226.1

[58] Field of Search ..... 4/223, 224, 225.1, 4/226.1, 224.1, 222, 302, 304, 309, DIG. 3

[56] References Cited

U.S. PATENT DOCUMENTS 4,937,892 7/1990 Syrenne ..... 4/224 X
5,084,920 2/1992 Kimball ..... 4/DIG. 3
5,195,720 3/1993 Nortier et al. ..... 4/DIG. 3
5,269,028 12/1993 Liao ..... 4/226.1

*Primary Examiner*—Robert M. Fetsuga
*Attorney, Agent, or Firm*—Ladas & Parry

[57] ABSTRACT

There is provided a chemicals mixed type automatic flushing device which can be easily provided at an existing flush valve. This automatic cleaning device comprises: a sensor for detecting the human body; a first electromagnetic valve attached to the existing flush valve and adapted to be opened and closed on the basis of an output of the sensor; a tank for accommodating chemicals therewithin; a second electromagnetic valve provided at the tank and adapted to be opened and closed on the basis of an output of the sensor; and a connection tube adapted for connecting the portion where a push-button of the flush valve is detached and the tank, and for introducing, into the flush valve, the chemicals which have flowed out from the tank when the second electromagnetic valve is opened to mix these into the flushing water which has flowed out when the first electromagnetic valve is opened.

4 Claims, 6 Drawing Sheets

CHEMICALS MIXED TYPE AUTOMATIC FLUSHING DEVICE

BACKGROUND OF THE INVENTION

This invention relates to a chemicals mixed type automatic flushing device, and more particularly to a device easily provided at an existing flush valve.

The structure of the flush valve widely used in general will now be described with reference to FIG. 4.

When a push-button 401 is depressed, a pilot valve 402 is raised. As a result, water existing within a small chamber 403 is passed through a connection tube 406, and flows into the stool. Thus, water pressure within the small chamber 403 lowers, so a piston valve 404 slides upwardly by pressure of water within a connection portion 405 of a water line 408. Thus, connection portion 405 and connection tube 406 are directly connected, so water of main current from the water pipe 408 flows into the stool.

Thereafter, water from connection portion 405 is passed through a small hole 407 provided at the piston valve 404, so the internal portion of small chamber 403 is filled with water for a second time. The piston valve 404 slides in a lower direction by pressure of water within the small chamber 403 so that it returns to the original position. Thus, the portion between water pipe 408 and connection tube 406 is closed, so flow-out of flushing water is stopped.

In the device related to this invention, construction work is implemented to such an existing flush valve to attach the flushing device thereto to mix chemicals into the flushing water. The configuration of the flushing device in this case is shown in FIG. 5.

A tank unit 508 for mixing chemicals is attached to the existing flush valve 400.

A tank 507 for accommodating chemicals 505 and flushing water 502 is connected to the connection tube 406 by means of a connection tube 506. In this example, projection 501 is provided at the front end portion of the connection tube 506. When flushing water flows out from flush valve 400, it is passed through connection tube 506, and flows backward into the tank 507.

Within the tank 507, a float 504 moving upwardly and downwardly in accordance with water level of the flushing water 502 is provided. This float 504 is connected to valve 503 within connection tube 506.

When push-button 401 is depressed so that flushing water flows out from flush valve 400, it flows backward into tank 507. When this flushing water flows backward up to a predetermined water level within tank 507, bouyancy is produced in float 504. Thus, valve 503 connected to float 504 closes the portion between connection tube 506 and tank 507. Thus, flowing into tank 507 of cleaning water is stopped. As a result, flushing water 502 does not flow into tank 507 in excess of a predetermined water level. Thus, flushing water is prevented from overflowing.

When flushing water 502 flows into tank 507, chemicals 505 are dissolved.

Thereafter, when flow-out of flushing water from flush valve 400 is stopped, valve 503 moves in a lower direction, resulting in the state where tank 507 and connection tube 406 are connected. Thus, flushing water 502 into which chemicals 505 are dissolved within tank 507 flows into stool 509. As a result, the surface of stool 509 is covered with a film of chemicals.

However, in this flushing device, it is necessary that a hole is formed in connection tube 406 to connect connection tube 506 thereto. Accordingly, construction work was difficult.

The structure of another device related to this invention is shown in FIG. 6.

Proximity and withdrawal of the human body are detected by a sensor (not shown), so a detection signal is outputted. Coil 613 of electromagnetic valve is brought into energization state, so plunger 610 biased by compression spring 614 slides in an upper direction of the figure. Thus, there results the state where water path 611 and water path 612 are directly connected. Flushing water existing within small chamber 603 is passed through water path 612 from water path 611, and flows into pipe 615. This flushing water is discharged into connection tube 606. Then, water within small chamber 603 flows out therefrom. As a result, pressure is lowered. Thus, piston valve 604 slides in an upper direction. Thus, there results the state where connection portion 605 of water line 616 and 10 connection tube 606 are directly connected. As a result, water of main current from water line 616 flows into the stool via connection tube 606.

When energization to coil 613 is stopped in accordance with an output from sensor, plunger 610 biased by compression spring 614 slides in a lower direction of the figure so that it returns to the original position. Thus, the portion between water path 611 and water path 612 is closed. Further, water existing at the connection portion 605 is passed through small hole 607, so small chamber 603 is filled with water. Thus, pressure of water within small chamber 603 is elevated to the same level as pressure of water within connection portion 605, and piston valve 604 slides in a lower direction. As a result, the portion between connection portion 605 of water line 616 and connection tube 606 is closed. Thus, flow-out of flushing water is stopped.

However, although there exist devices for carrying out automatic flushing, no device for carrying out automatic flushing by using chemicals exists.

SUMMARY OF THE INVENTION

Accordingly, an object of this invention is to provide a chemicals mixed type automatic flushing device which can be attached to an existing flush valve by simple construction, and which can carry out automatic flushing using chemicals.

To achieve the above-mentioned object, in accordance with this invention, there is provided a chemicals mixed type automatic flushing device comprising: a sensor for detecting the human body; a first electromagnetic valve attached to an existing flush valve and adapted to be opened and closed on the basis of an output of the sensor; a tank for accommodating chemicals; a second electromagnetic valve provided at the tank and adapted to be opened and closed on the basis of an output of the sensor; and a connection tube adapted for connecting the portion where the push-button of the flush valve is detached and the tank, and for introducing, into the flush valve, the chemicals which have flowed out from the tank when the second electromagnetic valve is opened to mix it into the flushing water which has flowed out when the first electromagnetic valve is opened.

In operation, the first electromagnetic valve is opened on the basis of an output of the sensor which has detected the human body. As a result, flushing water flows from the flush valve into the stool. Further, the second electromagnetic valve is opened on the basis of an output of sensor. As a result, chemicals within the tank are introduced into the flush valve via the connection tube, and are mixed into the flushing water. Thus, the surface of the stool is covered with a film of chemicals. Such automatic flushing using chemicals can be carried out by simple construction work comprising the steps of attaching the first electromagnetic valve to the flush valve and connecting the connection tube to the portion where the push-button of the flush valve is detached.

DESCRIPTION OF THE PREFERRED EMBODIMENTS

Preferred embodiments of chemicals mixed type automatic flushing devices according to this invention will now be described.

The chemicals mixed type automatic flushing devices according to these embodiments are adapted to be attached to the existing flush valves.

Figure 1:
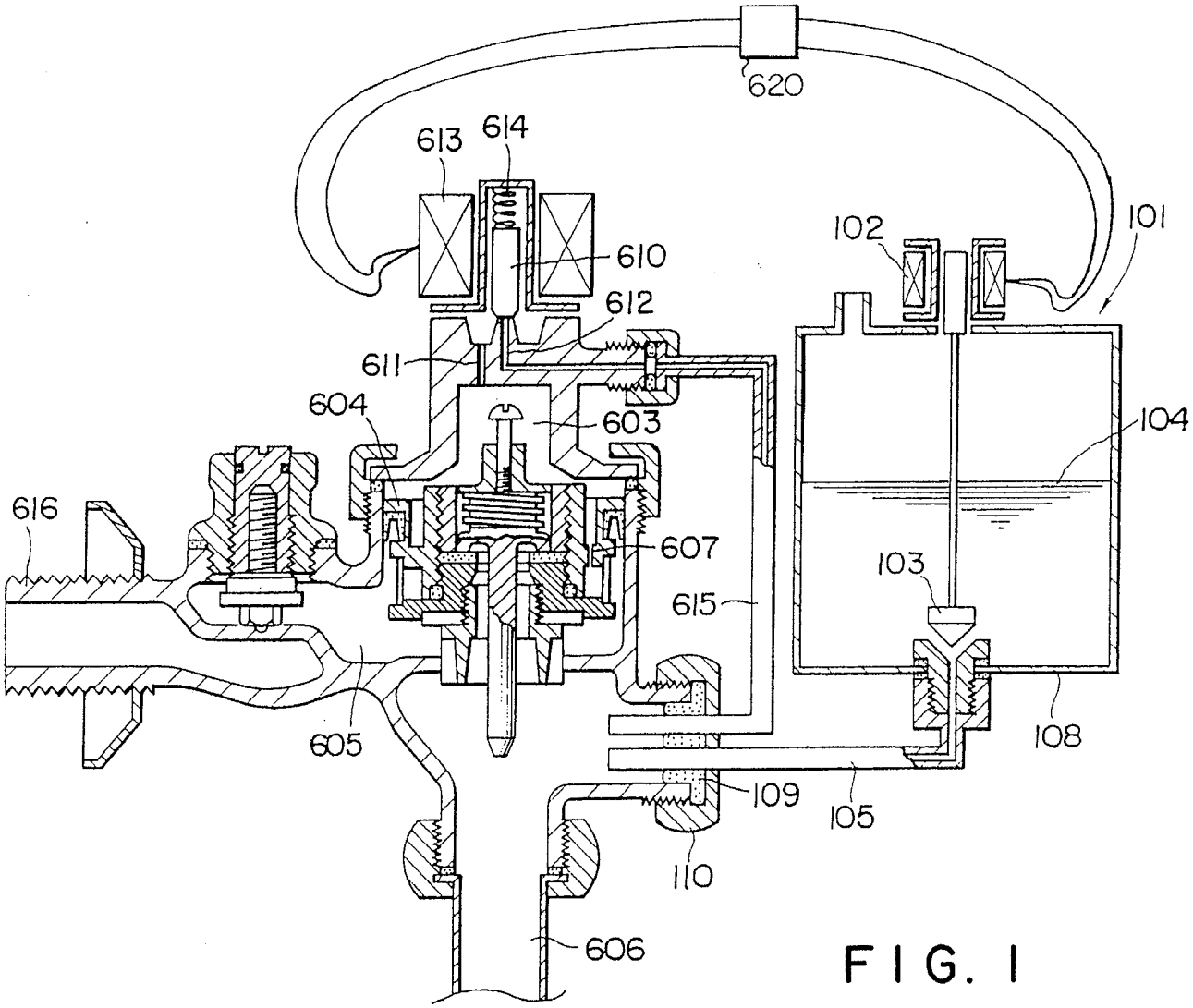
FIG. 1 is a longitudinal cross sectional view showing the configuration of a chemicals mixed type automatic flushing device according to a first embodiment of this invention.
Figure 6:
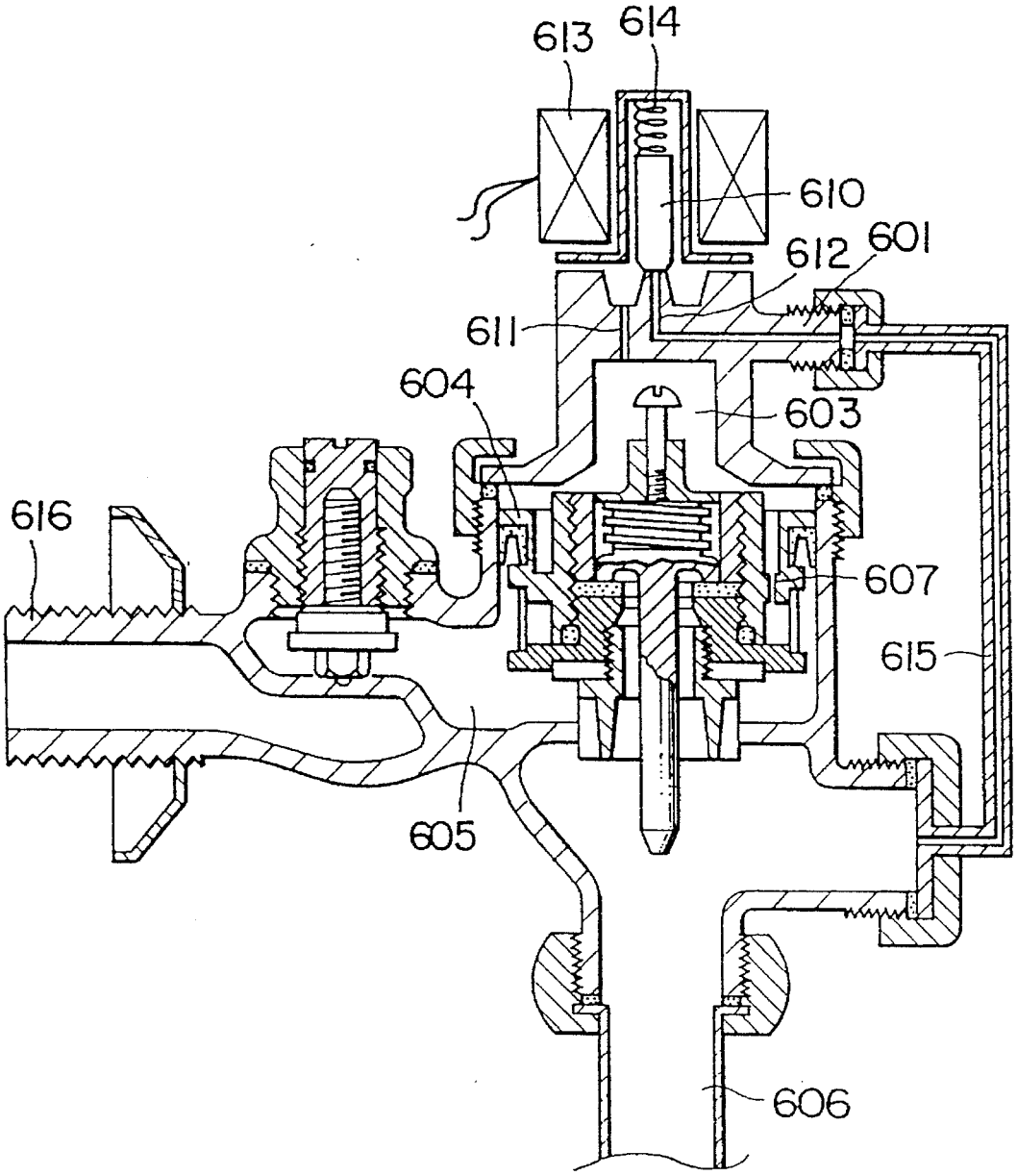
FIG. 6 PRIOR ART
FIG. 6 is a longitudinal cross sectional view showing the configuration of an automatic flushing device for carrying out automatic flushing by using electromagnetic valves.

Initially, the configuration of an automatic flushing device using chemicals according to the first embodiment of this invention is shown in FIG. 1. In this figure, components are common to components of the device shown in FIG. 6 except for tank unit 101 for allowing chemicals to flow out, and the same reference numerals are respectively attached to the same components and their repetitive explanation is omitted.

Tank unit 101 comprises a tank 108 for containing chemicals 104, a coil 102 of an electromagnetic valve, a valve 103, a connection tube 105 for connecting the portion where the push-button of the flush valve is detached and tank 108, a rubber packing 109, and a cap nut 110.

When a sensor (620) detects proximity and withdrawal of the human body, coil 102 of the electromagnetic valve is energized, and valve 103 moves in an upper direction in the figure so that it is opened. As a result, chemicals 104 within tank 108 are passed through connection tube 105, and are caused to flow out into the stool.

Figure 4:
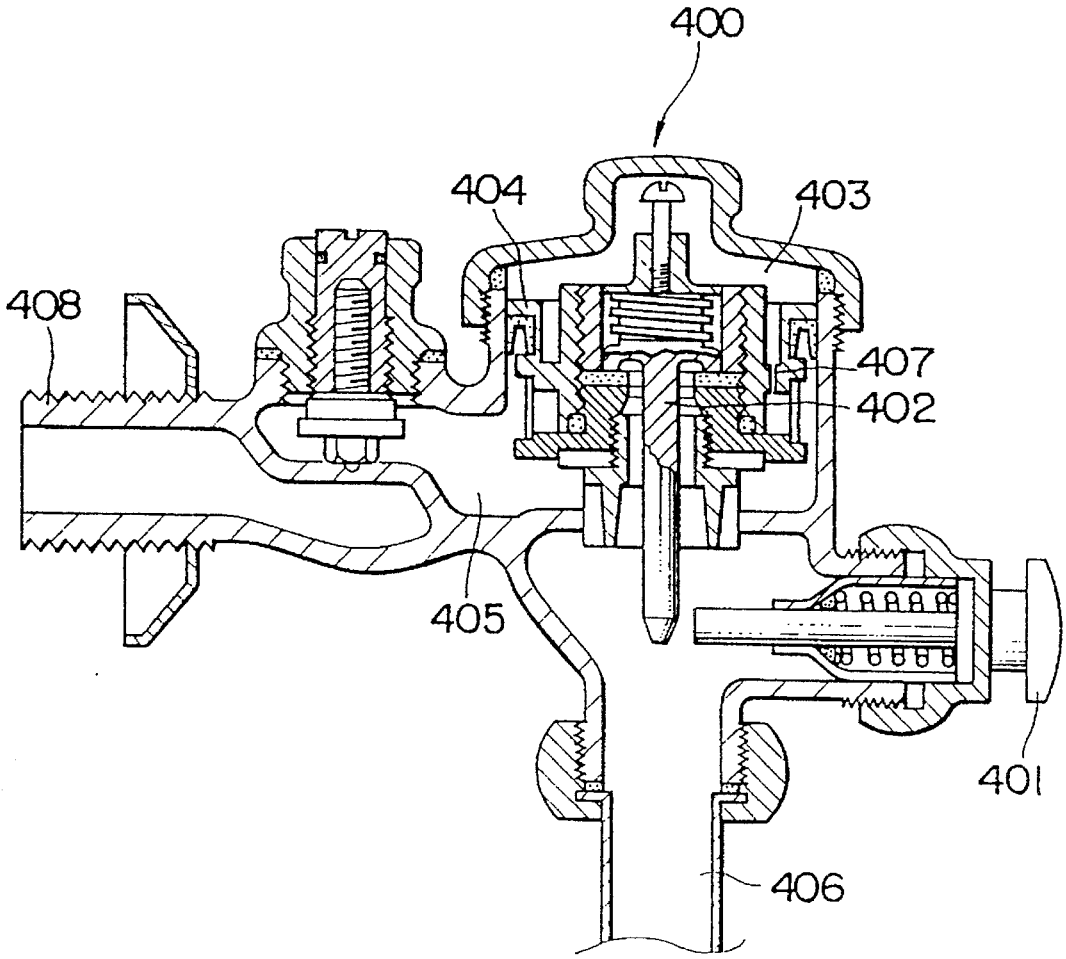
FIG. 4 PRIOR ART
FIG. 4 is a longitudinal cross sectional view showing the configuration of a push-button type flushing device related to this invention.
Figure 5:
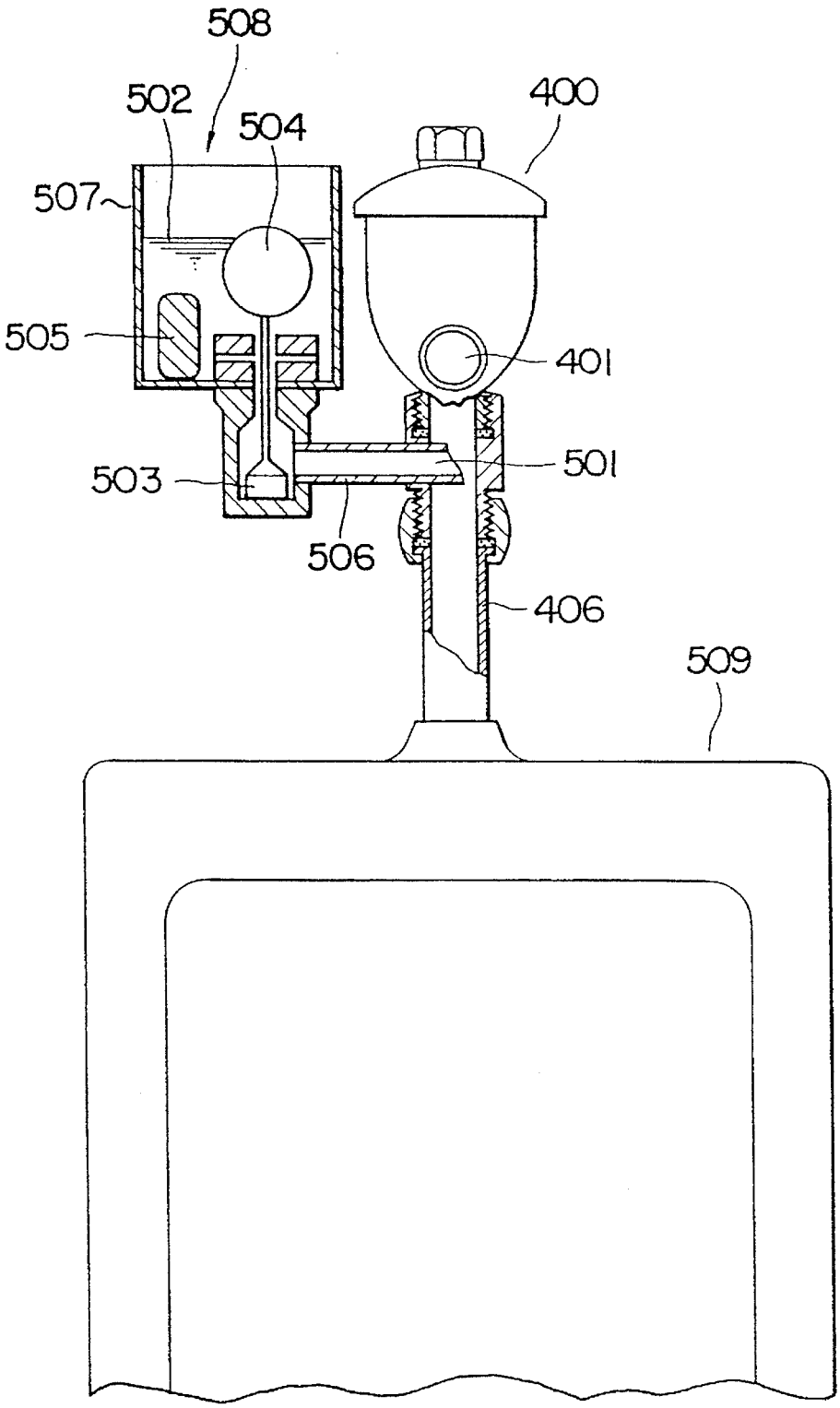
FIG. 5 PRIOR ART
FIG. 5 is a longitudinal cross sectional view showing the configuration of a push-button type flushing device for carrying out flushing by using chemicals.

Construction work for adding tank unit 101 to the device shown in FIG. 4 is as follows. The push-button of the flush valve is undone to penetrate connection tube 105 therethrough to connect connection tube 105 to the flush valve by using rubber packing 109 and cap nut 110. As stated above, the flushing device of this embodiment can be attached to the existing flush valve by simple construction work, thus making it possible to easily carry out automatic flushing by using chemicals.

Figure 3A:
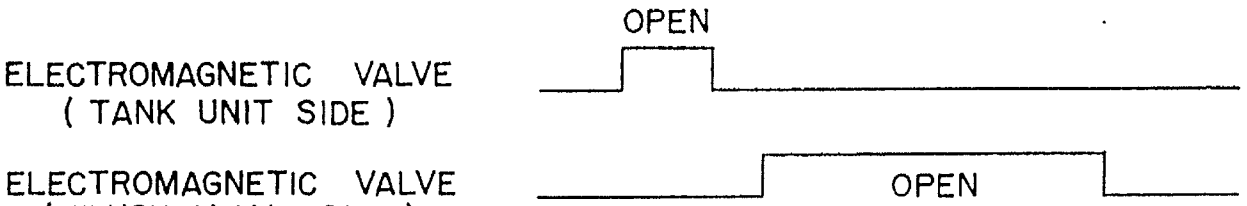
FIGS. 3(*a*) to (*c*) are time charts showing the opening timings of the electromagnetic valve on the tank unit side and electromagnetic valve on the flush valve side in the chemical mixed type automatic flushing device according to the first embodiment of this invention.
Figure 3B:
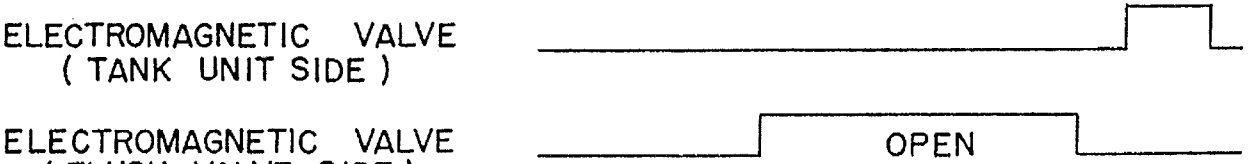
Figure 3C:
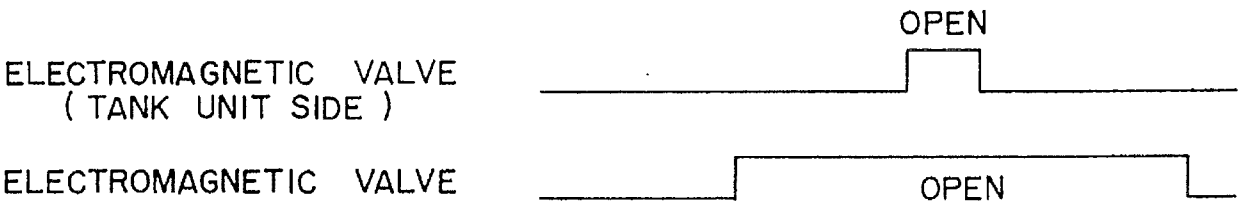

The timings for causing a current to flow in coil 102 on the tank unit side and coil 613 on the flush valve side to open respective electromagnetic valves will now be described. The case where the electromagnetic valve on the tank unit side is opened and the electromagnetic valve on the flush valve side is then opened is shown in FIG. 3(*a*). In this case, chemicals first flow from the tank unit into the stool to form a film on the surface, whereupon flushing water flows out.

The time chart in the case where the electromagnetic valve on the flush valve side is first opened is shown in FIG. 3(*b*). The electromagnetic valve on the flush valve side is opened, so flushing water flows into the stool. Immediately thereafter, the electromagnetic valve on the tank unit side is opened, so chemicals flow into the stool. Thus, a film is formed.

Further, the time chart in the case where the electromagnetic valve on the tank unit side is opened for a time period during which the electromagnetic valve on the flush valve side is opened is shown in FIG. 3(*c*). The electromagnetic valve on the tank unit side is opened for a time period during which the electromagnetic valve on the flush valve side is opened, so flushing water flows into the stool, and chemicals are mixed into the flushing water. While the examples of three kinds of timings where respective electromagnetic valves are opened have been described above, the electromagnetic valves may be controlled by any timing.

Figure 2:
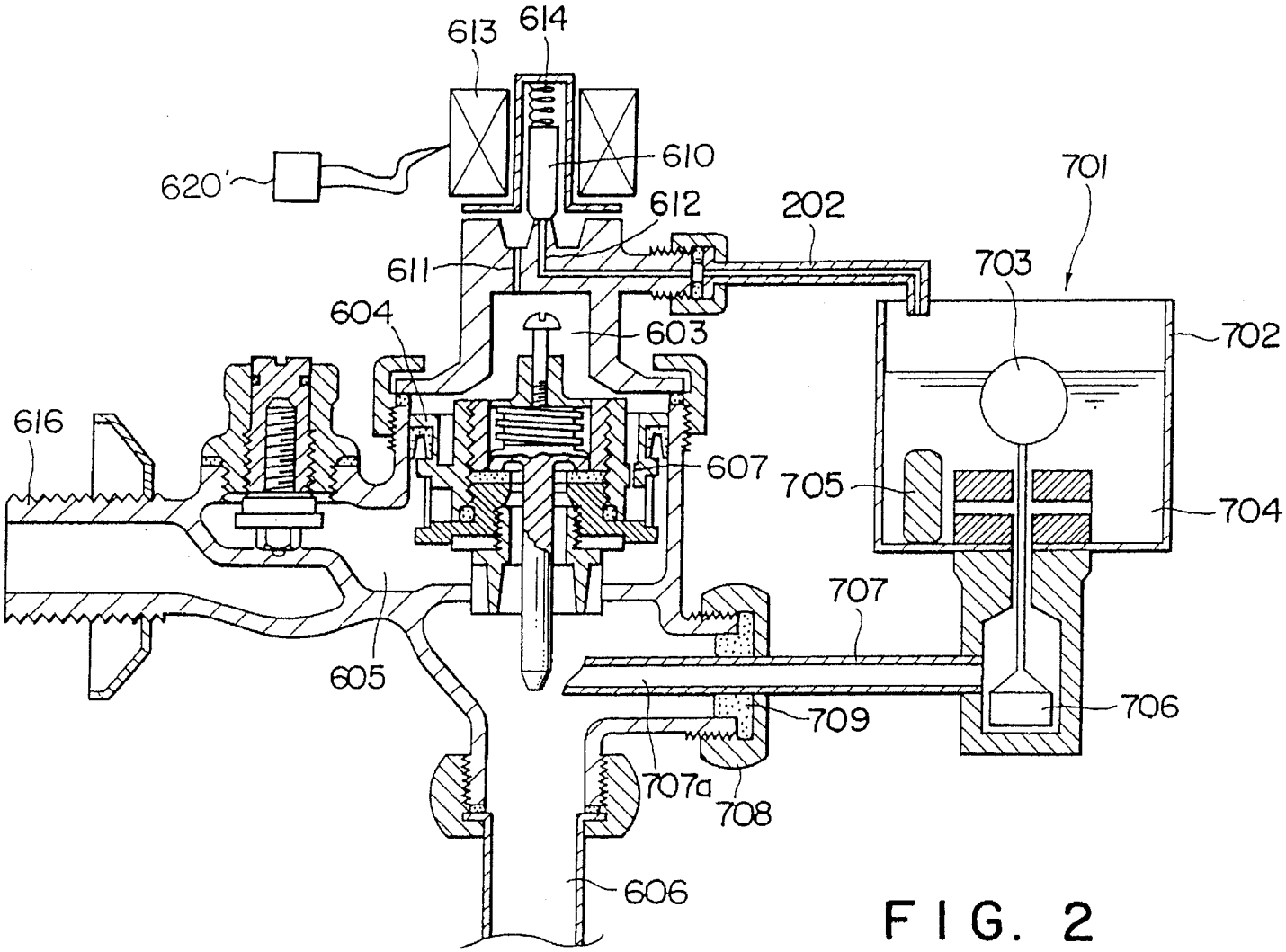
FIG. 2 is a longitudinal cross sectional view showing the configuration of a chemicals mixed type automatic flushing device according to a second embodiment of this invention.

The configuration of a chemicals mixed type automatic flushing device according to a second embodiment of this invention is shown in FIG. 2. This embodiment is characterized in that tank unit 701 using float 703 is employed in place of tank unit 101 using an electromagnetic valve in the first embodiment.

This tank unit 701 includes tank 702, float 703, chemicals 705, valve 706, connection tube 707, rubber packing 709, and cap nut 708. Coil 613 of the electromagnetic valve is energized by detecting operation of a sensor 620, so plunger 610 slides in an upper direction so that water paths 611 and 612 are connected. Thus, flushing water within small chamber 603 is passed through pipe 202, and flows into tank 702. As a result, water pressure within small chamber 603 is lowered, so piston valve 604 slides in an upper direction. Thus, connection portion 605 and connection tube 606 are connected. Water of main current of water pipe 616 flows into connection tube 606, and is passed through valve 706 by projection 707*a* of connection tube 707 of tank unit 701. Thus, flushing water 704 flows into tank 702. When flushing water 704 stays up to a predetermined level, float 703 floats. Thus, valve 706 is closed. Chemicals 705 are dissolved into flushing water 704 within the tank 702.

Energization to coil 613 is stopped. Water pressure within small chamber 603 rises. When piston valve 604 returns to the original position, supply of water of main current is stopped. The valve 706 is lowered, so connection tube 707 and tank 702 are connected. Flushing water 704 into which chemicals 705 are dissolved within tank 704 flows into the stool from connection tube 707 through connection tube 606.

Also in the second embodiment, construction work for attaching tank unit 701 to an existing flush valve is easy. The push-button of the flush-button is undone to penetrate connection tube 707 of tank unit 701 to fix it by using rubber packing 709 and cap nut 708. Further, pipe 202 for introducing cleaning water from small chamber 603 discharged by the operation of the electromagnetic valve into tank 702 is attached to pipe 202. As stated above, automatic flushing using chemicals can be carried out in an existing lavatory without necessity of a large-scale construction work.

The above-described embodiments are presented only for illustrative purpose, and do not limit this invention in any sense. For example, an electromagnetic valve of a mechanism different from those shown in FIGS. 1 and 2 may be used to control flow-out of flushing water. Further, while, in the second embodiment shown in FIG. 2, in order that flushing water which has flowed out when the electromagnetic valve is opened does not overflow tank 702, a measure is taken such that floats 703 and 706 are used so that flushing water does not flow into the tank in excess of a predetermined water level, any other structure may be employed. Alternatively, if there is no possibility that flushing water may overflow the tank, any device having no structure stated above may be also employed.

What is claimed is:

1. A control device for a flush valve comprising:

a sensor for detecting a human body;

a first electromagnetic valve for attachment to the flush valve for opening and closing the flush valve on the basis of a first output of the sensor;

a tank for accommodating chemicals therewithin, the tank having an outlet;

a second electromagnetic valve at the tank for opening and closing the outlet on the basis of a second output of the sensor; and a connection tube for connecting the flush valve and the outlet of the tank and for introducing into the flush valve the chemicals from the tank when the second electromagnetic valve is opened, whereby to mix the chemicals into flushing water that flows through the flush valve when the first electromagnetic valve is opened.

2. The control device as set forth in claim 1, wherein the first electromagnetic valve is opened at a time later than the second electromagnetic valve.

3. The control device as set forth in claim 1, wherein the first electromagnetic valve is opened at a time earlier than the second electromagnetic valve.

4. The control device as set forth in claim 1, wherein the second electromagnetic valve is opened for a time period during which the first electromagnetic valve is opened.

* * * * *